US005650252A

United States Patent [19]

Ng et al.

[11] Patent Number: 5,650,252

[45] Date of Patent: Jul. 22, 1997

[54] TONER GRAFTING PROCESSES

[75] Inventors: T. Hwee Ng, Mississauga; Arthur Helbrecht; Raj D. Patel, both of Oakville; Michael A. Hopper, Toronto; Richard P. N. Veregin, Mississauga, all of Canada

[73] Assignee: Xerox Corporation, Stamford, Conn.

[21] Appl. No.: 669,118

[22] Filed: Jun. 24, 1996

[51] Int. Cl.[6] ..... G03G 9/087

[52] U.S. Cl. ..... 430/109; 430/137

[58] Field of Search ..... 430/109, 110, 430/137

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,346,797 | 9/1994 | Kmiecik-Lawrynowicz et al. | 430/137 |
| 5,364,729 | 11/1994 | Kmiecik-Lawrynowicz et al. | 430/137 |

*Primary Examiner*—John Goodrow
*Attorney, Agent, or Firm*—E. O. Palazzo

[57] ABSTRACT

A process for the preparation of toner comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution;

(iv) heating said bound aggregates above about the Tg of the resin; and (v) thereafter washing the toner obtained, adding initiator, adding monomer, polymerizing by heating, and thereafter cooling, followed by an optional second washing.

33 Claims, No Drawings

TONER GRAFTING PROCESSES

BACKGROUND OF THE INVENTION

The present invention is generally directed to toner processes, and more specifically, to aggregation and coalescence processes for the preparation of toner compositions. In embodiments, the present invention is directed to the economical in situ chemical preparation of toners without the utilization of the known pulverization and/or classification methods, and wherein in embodiments toner compositions with a volume average diameter of from about 1 to about 25, and preferably from 1 to about 10 microns and narrow GSD of, for example, from about 1.16 to about 1.31 as measured on the Coulter Counter can be obtained, and wherein subsequent to preparation there is grafted onto the toner surface polymer primarily to improve the toner triboelectric characteristics and improve the toner admix properties. In embodiments, thus after the toner is prepared by emulsion/aggregation/coalescence methods as illustrated herein, the toner is washed, surfactant, initiator, and additional monomer are added, thereafter polymerization is accomplished and there is formed on the toner surface a layer of polymer obtained from additional monomer. The resulting toners can be selected for known electrophotographic imaging, printing processes, including color processes, and lithography. In embodiments, the present invention is directed to a process comprised of preparing, or providing a latex or emulsion mixture comprised of suspended sub micron resin particles of, for example about 0.01 microns to 0.5 microns in volume average diameter, in an aqueous solution containing an ionic surfactant such as an anionic surfactant in the amounts of 0.5 to 10% and a non ionic surfactant in an amount of 0.1 to 5% (weight percent throughout unless otherwise stated) and shearing this mixture with a pigment dispersion comprised of finely grounded pigments which are in the range of 50 to 250 nanometers dispersed in non ionic surfactant, optional toner additives such as release agents, in an aqueous mixture containing a counterionic surfactant such as a cationic surfactant, which is in the range of 0.1% to 5% by weight, thereby causing a flocculation of resin particles, pigment particles and optional charge control agent, followed by heating at about 5° to about 40° C. below the resin Tg and preferably about 5° to about 25° C. below the resin Tg while stirring of the flocculent mixture, which is believed to form statically bound aggregates of from about 1 micron to about 10 microns in volume average diameter, comprised of resin, pigment and optionally charge control particles, and thereafter heating to coalesce the formed bound aggregates about above the Tg (glass transition temperature) of the resin. The size of the aforementioned statistically bonded aggregated particles can be controlled by adjusting the temperature in the below the resin Tg heating stage. An increase in the temperature can cause an increase in the size of the aggregated particle. Heating the mixture about above, or in embodiments equal to the resin Tg generates toner particles with, for example, an average particle volume diameter of from about 1 to about 25 and preferably from about 1 to about 10 microns. It is believed that during the heating stage, the components of aggregated particles fuse together to form composite toner particles, followed by the toner particles being washed several times, such as about 10 times in embodiments with water to remove the surfactants. Subsequently there is formed on the toner surface a polymer layer by adding monomer, initiator and optional surfactant to the toner obtained, polymerizing the monomer by heating, cooling, and washing.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner.

Emulsion/aggregation/coalescence processes for the preparation of toners are illustrated in a number of patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. These toners can then be surface treated, and more specifically, have a polymer grafted to the surface thereof by the adding thereto of monomer and polymerizing.

SUMMARY OF THE INVENTION

It is an object of the present invention to provide toner processes with many of the advantages illustrated herein.

In another object of the present invention there are provided simple and economical chemical processes for the direct preparation of black and colored toner compositions with, for example, excellent pigment dispersion and narrow, for example about 1.15 to about 1.30, GSD.

In another object of the present invention there are provided simple and economical in situ processes for black and colored toner compositions by emulsion/aggregation/coalescence process comprised of preparing an anionic latex or emulsion mixture containing suspended sub-micron polymeric resin particles, anionic surfactant, and a nonionic surfactant in water, (ii) shearing the anionic latex mixture with a cationic pigment mixture containing a pre-dispersed pigment, a cationic surfactant and optional additives such as release agents in water thereby causing a flocculation of the pigment particles with the latex particles, which on further stirring and testing at temperatures of 5° to 15° C. below the resin Tg results in the formation of electrostatically stable aggregates which are in the range of 2–10 microns in volume average diameter as measured by the Coulter Counter; (iii) adding additional, for example 1 to 10 weight percent, of anionic or nonionic surfactant to the formed aggregates to, for example, increase their stability and to retain the particle size and particle size distribution during the heating stage; and (iv) coalescing or fusing the aforementioned aggregated particle mixture by heat to toner composites, or a toner composition comprised of resin, pigment, washing the said obtained toner particles; subsequently subjecting the toner obtained to seed emulsion polymerization.

In a further object of the present invention there is provided a process for the preparation of toner compositions with an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter, and which toner contains thereon a surface layer of polymer to thereby improve the toner tribo and the toner admix.

In a further object of the present invention there is provided a process for the preparation of toner compositions with certain effective particle sizes by controlling the temperature of the aggregation which comprises stirring and heating about below the resin glass transition temperature (Tg).

Moreover, in a further object of the present invention there is provided a process for the preparation of toner compositions, which after fixing to paper substrates results in images with a gloss of from 20 GGU (Gardner Gloss Units) up to 70 GGU as measured by Gardner Gloss meter matching of toner and paper.

In another object of the present invention there is provided a composite toner particles of a core / shell type of structure where the core os comprised of polymeric resin with pigment, and the shell is comprised of a thin layer of polymer coating, conducted by seed polymerization of the core particles resulting (i) charge enhancement and (ii) possibility decrease the RH sensitivity by appopriate choice of monomers, in yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Moreover, in another object of the present invention there are provided processes for the preparation of toner containing toner resin and pigment, wherein a toner is prepared by emulsion/aggregation/ coalescence as illustrated herein, followed by washing thereof primarily for the purpose of removing free surfactants and polyacrylic acid, and thereafter accomplishing seeded emulsion polymerization wherein latex particles of an effective size, for example from about 50 to about 200 nanometers are selected as seeds to grow on the final product, and more specifically, wherein coalesced toner particles with a volume average diameter of from about 1 to about 10, and preferably from about 3 to about 7 microns are selected as the seed emulsion core, followed by the addition of monomer, surfactant, and initiator, and polymerizing by heating to provide a toner with a surface polymer layer, or a surface shell after polymerization the toner is cooled, washed again, and dried.

These and other objects of the present invention are accomplished in embodiments by the provision of toners and processes thereof. In embodiments of the present invention, there are provided processes for the economical direct preparation of toner by improved flocculation or heterocoagulation, and coalescence, and wherein the temperature of aggregation can be utilized to control the final toner particle size, that is volume average diameter, and wherein there is subsequently accomplished a seeded polymerization to form a surface polymer layer on the toner to provide a charge on the core particle. In embodiments, the present invention is directed to a process for the preparation of toner containing resin, pigment and optional additives comprising (i) preparing a latex or an emulsion mixture which mixture is comprised of sub-micron resin particles, an ionic surfactant, such as an anionic and a non-ionic surfactant in water; (ii) heating the latex with a pigment dispersion comprised of a pigment, a counter ionic surfactant such as a cationic surfactant and optional additives; (iii) heating while stirring the above sheared blend to a temperature below the resin Tg to form electrostatically bound toner size aggregates with a narrow particle size distribution; (iv) adding additional anionic surfactant in the amount range of 1 to 10 percent by weight of reactor content to the formed aggregates to stabilize and retain the particle size and GSD during the further heating stage;

(v) heating the bound aggregates of (iii) above about the Tg of the resin to coalesce;

(vi) thereafter washing the toner obtained to remove free surfactants, and to enable a toner surfactant concentration of, for example, less than about 1.2 weight percent; adding initiator, adding monomer, adding surfactant, polymerizing by heating, cooling, followed by an optional second washing.

In embodiments, the present invention is directed to processes for the preparation of toner compositions, which comprises initially with an anionic latex of sub micron suspended resin particles comprised of polymer components such as poly(styrene butadiene—acrylic acid) or poly (styrene butylacrylate—acrylic acid); and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant, with a aqueous pigment dispersion, comprised of for example finely grounded pigment particles containing a non ionic dispersant, a counterionic surfactant to that of the said latex, for example a cationic surfactant, such as benzalkonium chloride, is sheared using a high shearing device, such as a Brinkmann Polytron, an IKA homogenizer, resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5° to about 15° C., and allowing the formation of electrostatically stabilized aggregates ranging from about 0.5 micron to about 10 microns; followed by the addition of extra anionic stabilizer in the range of 0.5 to 10% by weight of the reactor content; followed by heating above about the resin Tg, for example from about 5° to about 50° C., to cause coalescence of the latex, pigment particles and followed by washing with, for example, hot, at a temperature of about 50° to about 70° C., water to partially remove, for example, surfactants, and drying such as by use of an Aeromatic fluid bed dryer, freeze dryer, or spray dryer; whereby toner particles comprised of resin and pigment, and optional additives with various particle size diameters can be obtained, such as from about 1 to about 10 microns in volume average particle diameter as measured by the Coulter Counter; and subsequently accomplishing seed polymerization to enable the formation of a polymer on the toner surface. In seed polymerization, latex particles of a size of from about 50 to about 200 nanometers are selected as seeds for growth into a final latex product, and more specifically, for growth to the coalesced toner particles of a preferable size of from about 3 to about 10 microns in volume average diameter. The coalesced toner obtained is first washed as indicated herein and wherein the surfactant concentration is reduced to from about 2, and more specifically, from about 1.2 weight percent to from about 0.05 to about 1 weight percent, and the amount of initiator added is from about 0.5 to about 50 weight percent, the amount of monomer then added is from about 0.1 to about 10 weight percent, and preferably from about 1 to 4 weight percent, followed by heating at a temperature of from about 25° to about 90° C., and preferably from about 50° to about 70° C.; washing, especially washing with deionized water to remove surfactants, and drying, and wherein there is formed a toner with a polymer grafted to the surface thereof.

In the embodiments that follow after the coalesced toner is prepared it is subject to a seed emulsion polymerization as indicated herein.

Embodiments of the present invention include a process for the preparation of toner compositions comprised of resin and pigment comprising (i) preparing an anionic latex or emulsion mixture containing suspended sub-micron polymeric resin particles, anionic surfactant, and a nonionic surfactant in water; (ii) shearing the anionic latex mixture with a cationic pigment mixture containing a pre-dispersed pigment, a cationic surfactant and optional additives such as release agents in water thereby causing a flocculation of the pigment particles with the latex particles, which on further stirring and testing at temperatures of 5° to 15° C. below the resin Tg results in the formation of electrostatically stable aggregates which are in the range of 2–10 microns in volume average diameter; (iii) adding additional anionic surfactant in the amount range of from about 1 to about 10 percent by weight of reactor contents, or solids, to the formed aggregates to stabilize and retain the particle size and GSD during the further heating stage; and (iv) heating to, for example, from about 60° C. to about 95° C. the statically bound aggregated particles of (iii) to form said toner composition comprised of polymeric resin and pigment.

Also, in embodiments the present invention is directed to processes for the preparation of toner compositions which comprise (i) preparing a latex or an emulsion of sub micron resin particles comprised of, for example, poly(styrene-butylacrylate- acrylic acid), PLIOTONE™ or poly(styrene-butadiene- acrylic acid), and which resin particles are present in various effective amounts, such as from about 40 percent to about 60 percent by weight of the toner, and wherein the polymer resin latex particle size is from about 0.1 micron to about 3 microns in volume average diameter, and ionic surfactant, such as an anionic surfactant like sodium dodecylsulfate, dodecylbenzene sulfonate or NEOGEN R™, from about 0.5 to about 2 percent by weight of water, a nonionic surfactant such polyethylene glycol or polyoxyethylene glycol nonyl phenyl ether or IGEPAL 897™ obtained from GAF Chemical Company, from about 0.5 to about 3 percent by weight of water, (ii) adding the aforementioned ionic latex mixture to an aqueous pigment dispersion comprised of dispersing a pigment, such as carbon black like REGAL 330®, HOSTAPERM PINK™, or PV FAST BLUE™ of from about 2 to about 10 percent by weight of toner in an aqueous mixture containing a cationic surfactant, such as dialkylbenzene dialkylammonium chloride like SANIZOL B-S0™, available from Kao, or MIRAPOL™, available from Alkaril Chemicals, and from about 0.5 to about 2 percent by weight of water utilizing a high shearing device such as a Brinkmann Polytron or IKA homogenizer at a speed of from about 3,000 revolutions per minute to about 10,000 revolutions per minute for a duration of from about 1 minute to about 120 minutes; thereby causing a flocculation or heterocoagulation of pigment, charge control additive and resin particles; (iii) further stirring with a mechanical stirrer from about 250 to 500 rpm about below the resin Tg at, for example, about 5° C. to 25° C. below the resin Tg at temperatures of about 35° C. to 60° C. to form electrostatically stable aggregates of from about 0.5 micron to about 5 microns in volume average diameter; (iv) adding additional anionic surfactant or nonionic surfactant in the amount of from 0.5 percent to 10 percent by weight of reactor content to stabilize the aggregates formed in step (iii), (v) heating the statically bound aggregate composite particles at from about 60° C. to about 135° C. for a duration of about 60 minutes to about 600 minutes to form toner sized particles of from about 3 microns to about 7 microns in volume average diameter and with a geometric size distribution of from about 1.2 to about 1.3 as measured by the Coulter Counter; and (vi) washing the formed toner particles to remove the surfactant (vii) adding to the washed toner slurry an initiator, adding monomer(s), and a surfactant, and polymerizing the monomers to conduct a seed polymerization by heating, followed by cooling, followed by an optional second washing, filtering and drying thereby providing composite toner particles comprised of resin and pigment. Flow additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner. The continuous stirring in step (iii) can be accomplished as indicated herein, and generally can be effected at from about 200 to about 1,000 rpm for from about 1 hour to about 24 hours, and preferably from about 12 to about 6 hours.

Illustrative examples of specific resin particles, resins or polymers selected for the process of the present invention, and more specifically, for the preparation of the coalesced toner include known polymers such as poly(styrene-butadiene), poly(para-methyl styrene-butadiene), poly (meta-methyl styrene-butadiene), poly(alpha-methyl styrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly(butyl methacrylate-isoprene), poly(methylacrylate-isoprene), poly (ethylacrylate-isoprene), poly(propylacrylate-isoprene), and poly(butylacrylate-isoprene); polymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexylene-terephthalate, polyheptadene-terephthalate, polyoctalene-terephthalate, and the like. The resin selected, which generally can be in embodiments known thermoplastics such as styrene acrylates -acrylic acid, styrene butadienes -acrylic acid, styrene methacrylates -acrylic acid, or polyesters, is present in various effective amounts, such as from about 85 weight percent to about 98 weight percent of the toner, and can be of small average particle size, such as from about 0.01 micron to about 1 micron in volume average diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally, acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional, and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites, and the like. As colored pigments, there can be selected cyan, magenta, yellow, red, green, brown, blue or mixtures thereof. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as dialkylphenoxypoly(ethyleneoxy) ethanol, available from Rhoneo-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

The cationic and anionic surfactants can be interchanged or reversed, wherein the pigment dispersion may contain anionic surfactant while the latex particles contain a cationic and a non ionic surfactant.

Examples of the surfactant, which is added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregates comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972®, available from Degussa, in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

Aggregation/Coalescence:

780 Grams of an anionically charged latex (40 percent solids, 60 percent or parts of water) containing styrene and butyl acrylate in a weight ratio of 82:18, and 2 parts per 100 parts of acrylic acid were simultaneously mixed with a pigment solution containing 22.8 grams (54.4 percent solids) of dispersed BHD 6000 Sunsperse Cyan 15:3 Pigment, obtained from Sun Chemicals, 7.8 grams of cationic surfactant (SANIZOL B™) and 720 grams of water to 1,200 grams of water while being polytroned. The contents were then transferred into a reaction vessel, and the temperature raised to 45° C. and held there for 1.5 hours to perform the aggregation. The particle size measured was 4.4 microns with a GSD of 1.21. 45 Milliliters of 20 percent anionic surfactant (NEOGEN R™) solution was then added to the aggregates to stabilize them and minimize further growth during coalescence. The coalescence was performed by raising the temperature to 93° C., and held at 93° C. for a period of 4 hours. The particle size measured upon completion was found to be 4.3 microns (volume average diameter throughout, measured by a Coulter Counter) with a GSD of 1.20.

The above aggregated/coalesced particle slurry was washed three times with 3 liters of deionized water in a vacuum filter and dried in a freeze dryer. The dry powder was evaluated for tribo charging and the Q/M at 20 percent RH and 80 percent RH were −20 μC/gram and −6 μC/gram, respectively.

EXAMPLE II

Seeded Emulsion Polymerization (Styrene) on Coalesced Particles

900 Grams of the above unwashed aggregated/coalesced particle slurry were first dewatered in a vacuum filter to remove the mother liquor from the toner particles. The toner cake was slurried with 3 liters of deionized water and filtered to remove the surfactants. Deionized water was then added to the washed toner cake so that the total weight was 900 grams. The toner-in-water mixture was then mixed in a 1 liter reactor at 250 rpm. 2 Grams of styrene monomer were added dropwise into the reactor and mixed for 30 minutes to form an emulsion. 20 Milliliters of 2.5 percent ammonium persulfate initiator solution were added to the reactor. After purging with nitrogen at 200 milliliters/minute for 2 minutes, the reactor was sealed and the reaction was allowed to proceed at 60° C. for 4 hours.

The above aggregated/coalesced particle slurry with a styrene polymer layer was washed three times with 3 liters of deionized water in a vacuum filter and dried in a freeze dryer. The dry powder was evaluated for tribocharging and the Q/M at 20 percent RH and 80 percent RH were −52 μC/gram and −13 μC/gram, respectively. Example II showed a marked improvement in the tribo values when the toner particles were treated by the seeded emulsion polymerization process.

EXAMPLE III

Seeded Emulsion Polymerization (Trifluoroethylmethacrylate) on Coalesced Particles 900 Grams of the above unwashed aggregated/coalesced particle slurry were first dewatered in a vacuum filter to remove the mother liquor from the toner particles. The toner cake was slurried with 3 liters of deionized water and filtered to remove the surfactants. Deionized water was then added to the washed toner cake so that the total weight was 900 grams. The toner-in-water mixture was then mixed in a 1 liter reactor at 200 rpm. 2 Grams of trifluoroethylmethacrylate (TFEMA) monomer were added dropwise into the reactor and mixed for 30 minutes to form an emulsion. 20 Milliliters of 2.5 percent ammonium persulfate initiator solution were added to the reactor. After purging with nitrogen at 200 milliliters/minute for 2 minutes, the reactor was sealed and the reaction was allowed to proceed at 60° C. for 4 hours.

The above aggregated/coalesced particle slurry was washed three times with 3 liters of deionized water in a vacuum filter and dried in freeze dryer. The dry powder was evaluated for tribocharging and the Q/M at 20 percent RH and 80 percent RH were −70 μC/gram and −17 μC/gram, respectively. Example III toner evidenced a substantial improvement in the toner tribo values.

EXAMPLE IV

Seeded Emulsion Polymerization (Trifluoroethylmethacrylate/Methyl-methacrylate) on coalesced particles 900 Grams of the above unwashed aggregated/coalesced particle slurry were first dewatered in a vacuum filter to remove the mother liquor from the toner particles. The toner cake was slurried with 3 liters of deionized water and filtered to remove the surfactants. Deionized water was then added to the washed toner cake so that the total weight was 900 grams. The toner-in-water mixture was then mixed in a 1 liter reactor at 250 rpm. One gram of each trifluoroethylmethacrylate/methyl-methacrylate monomer was added dropwise into the reactor and mixed for 30 minutes to form an emulsion. 20 Milliliters of 2.5 percent ammonium persulfate initiator solution were added to the reactor. After purging with nitrogen at 200 milliliters/minute for 2 minutes, the reactor was sealed and the reaction was allowed to proceed at 60° C. for 4 hours.

The above aggregated/coalesced particle slurry was washed three times with 3 liters of deionized water in a vacuum filter and dried in a freeze dryer. The dry powder was evaluated for tribocharging and the Q/M at 20 percent RH was −42 μC/gram. No 80 percent RH data was measured. Example IV toner evidenced a substantial improvement in the toner tribo values when the toner particles were treated by the seeded emulsion polymerization.

| | Q/M, μC/g | |
|---|---|---|
| SAMPLE | 20% RH | 80% RH |
| EXAMPLE I | −20 | −6 |
| EXAMPLE II | −52 | −13 |
| EXAMPLE III | −70 | −17 |
| EXAMPLE IV | −40 | NA |

Tribo, or Q/M was determined by known methods, such as the Faraday Cage method.

Other modifications of the present invention may occur to those skilled in the art subsequent to a review of the present application and these modifications, including equivalents thereof, are intended to be included within the scope of the present invention.

What is claimed is:

1. A process for the preparation of a toner comprising: (i) preparing in water a latex or emulsion mixture, which mixture is comprised of submicron resin particles, an ionic surfactant, and a non-ionic surfactant; (ii) preparing a pigment dispersion comprised of a pigment, a counterionic surfactant with a charge polarity of opposite sign to that of the ionic surfactant and water; (iii) shearing the said counterionic pigment dispersion and ionic latex mixture resulting in a flocculation of pigment and latex particles; (iv) heating the resulting pigment and latex particles to a temperature below the glass transition temperature of the resin to form electrostatically bound toner size aggregates with a narrow size distribution; (v) adding additional ionic surfactant to stabilize the formed electrostatic aggregates; (vi) heating the resulting stabilized electrostatic aggregates to a temperature above the resin Tg to fuse said aggregates and form a composite toner of resin and pigment; (vii) thereafter washing the toner obtained with water to remove surfactants; (viii) adding to the washed toner slurry of (vii) an initiator, adding monomer, and a surfactant, polymerizing to conduct a seed polymerization of said monomer by heating, cooling, followed by an optional second washing.

2. A process in accordance with claim 1 wherein in (vii) after washing the toner obtained has a surfactant concentration of less than about 1.2 weight percent.

3. A process in accordance with claim 1 wherein in (vii) after washing the toner obtained has a surfactant concentration of from about 0.05 to about 1.2 weight percent.

4. A process in accordance with claim 1 wherein there is formed a toner core of resin, pigment, and optional charge additive, and as a shell, or surface layer thereover a polymer layer.

5. A process in accordance with claim 4 wherein the shell with said polymer layer results in a triboelectrical charge enhancement.

6. A process in accordance with claim 4 wherein the surfactant concentration is from about 0.05 to about 1 weight percent.

7. A process in accordance with claim 1 (viii) wherein the monomer amount is from about 0.1 to about 10 weight percent.

8. A process in accordance with claim 1(viii) wherein the monomer amount is from about 1 to about 4 weight percent.

9. A process in accordance with claim 1 wherein heating in (viii) is from about 40° C. to about 90° C.

10. A process in accordance with claim 1 wherein heating in (viii) is from about 50° C. to about 75° C.

11. A process in accordance with claim 1(viii) wherein the initiator amount is from about 0.5 to about 50 weight percent based on the weight percent of monomer.

12. A process in accordance with claim 1 (viii) wherein the initiator amount is from about 2 to about 20 weight percent based on the weight percent of monomer.

13. A process in accordance with claim 1 wherein the optional washing is accomplished with deionized water to enable removal of surfactants.

14. A process in accordance with claim 1 wherein the temperature below the resin Tg of (iv) controls the size of the aggregated particles to be in the range of from about 2.5 to about 10 microns in volume average diameter.

15. A process in accordance with claim 1 wherein the size of said aggregates can be increased to from about 2.5 to about 10 microns by increasing the temperature of heating in (iv) to from about room temperature to about 50° C.

16. A process in accordance with claim 1 wherein the surfactant utilized in preparing the pigment dispersion is a cationic surfactant, and the counterionic surfactant present in the latex mixture is an anionic surfactant.

17. A process in accordance with claim 1 wherein the surfactant utilized in preparing the pigment dispersion is an anionic surfactant, and the counterionic surfactant present in the latex mixture is a cationic surfactant.

18. A process in accordance with claim 1 wherein the heating of the bound aggregates to form toner size composite particles comprised of pigment, resin and optional additives is accomplished at a temperature of from about 10° C. above the Tg of the resin to about 95° C. for a duration of from about 1 hour to about 8 hours.

19. A process in accordance with claim 1 wherein the resin is selected from the group consisting of poly(styrene-butadiene), poly(para-methyl styrene-butadiene), poly (meta-methylstyrene-butadiene), poly(alpha-methylstyrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene) containing acrylic acid.

20. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

21. A process in accordance with claim 1 wherein the anionic surfactant is selected from the group consisting of sodium dodecyl sulfate, sodium dodecylbenzene sulfate and sodium dodecylnaphthalene sulfate.

22. A process in accordance with claim 1 wherein the pigment is carbon black, magnetite, cyan, yellow, magenta, or mixtures thereof.

23. A process in accordance with claim 1 wherein the toner particles isolated are from about 2 to about 15 microns in volume average diameter, and the geometric size distribution thereof is from about 1.15 to about 1.35.

24. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and charge agent.

25. A process in accordance with claim 1 wherein there is added to the surface of the formed toner metal salts, metal salts of fatty acids, silicas, metal oxides, or mixtures thereof in an amount of from about 0.1 to about 10 weight percent of the obtained toner particles.

26. A process in accordance with claim 1 wherein the toner is washed with water and the surfactants are removed from the toner surface, followed by drying.

27. A process in accordance with claim 1 wherein heating in (iv) is from about 5° C. to about 25° C. below the Tg.

28. A process in accordance with claim 1 wherein heating in (iv) is accomplished at a temperature of from about 29° C. to about 59° C.

29. A process in accordance with claim 1 wherein heating in (vi) is from about 5° C. to about 50° C. above the Tg.

30. A process in accordance with claim 1 wherein the resin Tg in (vi) is from about 50° C. to about 80° C.

31. A process for the preparation of toner comprising (i) preparing or providing a latex or an emulsion mixture which mixture is comprised of submicron resin particles, an ionic surfactant, such as an anionic and a non-ionic surfactant in water; (ii) heating the latex with a pigment dispersion comprised of a pigment, a counterionic surfactant comprised of a cationic surfactant and optional additives; (iii) heating while stirring the above sheared blend to a temperature below the resin Tg to form electrostatically bound toner size aggregates with a narrow particle size distribution; (iv) adding additional anionic surfactant in the range amount of from about 1 to about 10 percent by weight of the reactor contents to the formed aggregates to stabilize and retain the particle size and GSD during the further heating stage; (v) heating said aggregates above about the Tg of the resin; and (vi) thereafter washing the toner obtained, followed by adding initiator, adding monomer, polymerizing by heating, and then cooling, followed by an optional second washing.

32. A process which comprises shearing a a latex with a pigment dispersion wherein the said latex is comprised of suspended submicron resin particles of a size diameter of from about 0.05 to about 0.99 microns in an anionic surfactant and a nonionic surfactant, with a pigment dispersion comprised of submicron pigment particles stabilized by a nonionic dispersant and a counterionic surfactant with a charge of the opposite sign to that of said ionic surfactant, followed by heating the above sheared blend below about the glass transition temperature (Tg) of the resin to form toner size aggregates; followed by the addition of extra anionic or nonionic surfactant to stabilize the formed aggregates; heating said stabilized aggregates above about the Tg of the resin; and thereafter washing the toner obtained, followed by adding initiator, adding monomer, surfactants, polymerizing by heating, then cooling, followed by an optional second washing.

33. A toner obtained by the process of claim 32.

* * * * *